United States Patent [19]

Matsumoto et al.

[11] 3,990,924

[45] Nov. 9, 1976

[54] METHOD FOR PRODUCING HIGH MAGNETIC FLUX DENSITY GRAIN-ORIENTED ELECTRICAL STEEL SHEET AND STRIPS HAVING EXCELLENT CHARACTERISTICS

[75] Inventors: Fumio Matsumoto; Katuro Kuroki; Kiyoshi Ueno; Yasuhiro Shinkai; Shouzou Oota, all of Kitakyushu, Japan

[73] Assignee: Nippon Steel Corporation, Tokyo, Japan

[22] Filed: Aug. 27, 1975

[21] Appl. No.: 608,227

Related U.S. Application Data

[63] Continuation-in-part of Ser. No. 551,159, Feb. 20, 1975, abandoned, which is a continuation of Ser. No. 384,019, July 30, 1973, abandoned.

[30] Foreign Application Priority Data

Aug. 1, 1972 Japan ..... 47-76499

[52] U.S. Cl. ..... 148/111; 148/31.55; 148/112

[51] Int. Cl.[2] ..... H01F 1/04

[58] Field of Search ..... 148/111, 112, 31.55, 148/120, 11.5; 75/123 L

[56] References Cited

UNITED STATES PATENTS

| | | | |
|---|---|---|---|
| 2,169,711 | 8/1939 | Sendzimir | 148/11.5 |
| 2,473,156 | 6/1949 | Littmann | 148/11.5 |
| 3,287,183 | 11/1966 | Taguchi et al. | 148/111 |
| 3,636,579 | 1/1972 | Sakakura et al. | 148/111 |

*Primary Examiner*—Walter R. Satterfield
*Attorney, Agent, or Firm*—Toren, McGeady and Stanger

[57] ABSTRACT

A method for producing high magnetic flux density grain oriented electrical steel sheets or strips having a $B_8$ characteristic in the rolling direction of not less than 1.9 $Wb/m^2$ by hot rolling, continuous annealing for precipitation of the AlN, cold rolling into the final thickness, decarburization annealing, and finishing annealing. The cold rolling includes a final rolling at a strong reduction between 81 and 95%.

4 Claims, 4 Drawing Figures

0.35mm
B8 (Wb/m²)
1.95
1.90
1.85
(W17/50) (W/Kg)
1.40
1.35
1.30
1.25
1.20
50 100 150 250 450 600
Roll Diameter mm 0.35mm
B8 (Wb/m²)
1.95
1.90
1.85
(W17/50) (W/Kg)
1.40
1.35
1.30
1.25
1.20
50 450+50 600+50 600+50 450
Roll Diameter mm 0.30mm
B8 (Wb/m²)
1.95
1.90
1.85
(W17/50) (W/Kg)
1.30
1.25
1.20
1.15
1.10
50
600 + 50
600 + 150
600 + 250
600 + 450
600
Roll Diameter mm 0.30mm
B8 (Wb/m²)
1.95
1.90
1.85
(W17/50) (W/Kg)
1.30
1.25
1.20
1.15
1.10
50
450 + 50
450 + 50
450
Roll Diameter mm

METHOD FOR PRODUCING HIGH MAGNETIC FLUX DENSITY GRAIN-ORIENTED ELECTRICAL STEEL SHEET AND STRIPS HAVING EXCELLENT CHARACTERISTICS

This application is a continuation-in-part of our copending application Ser. No. 551,159, filed on Feb. 20, 1975 now abandoned, which in turn is a continuation of application Ser. No. 384,019 filed July 30, 1973 and now abandoned.

BACKGROUND OF THE INVENTION

1. Field of The Invention

The present invention relates to a method for producing grain oriented electrical steel sheet and strip whose grains have the orientation of {110} <001> and which is easily magnetizable in the rolling direction.

1. Description of The Prior Art

The magnetic properties required by grain oriented electrical steel are a high magnetic flux density and low iron loss characteristics.

Recently, increasing demands have been made for miniaturization and higher performance of electrical appliances, and for this purpose, it is necessary to reduce the weight of iron cores.

In general, in order to reduce the weight of iron cores used in various electrical applicances, a high degree of magnetic flux density must be utilized so that magnetic materials having good magnetization characteristics, namely good $B_8$ characteristic (magnetic flux density at magnetization strength of 8 AT/cm) are required.

As compared with a magnetic material having a low $B_8$ characteristic, a magnetic material having a high $B_8$ characteristic shows much lower iron loss at a high magnetic field and shows a low increase in rate of the iron loss with an accompanying increase in the magnetic flux density.

In view of the above requirements, the improvement in the magnetic density which is naturally required with an increase in the size of electrical applicances will be realized only by the development of high magnetic flux density grain-oriented electrical steel sheets.

The present invention has as its object the supplying of products meeting such demands, and provides grain-oriented electrical steel sheets with a high magnetic flux density, exhibiting the excitation characteristic, i.e., $B_8$ characteristic of at least 1.90 Wb/m$^2$ in the rolling direction which is far superior to the conventional grain-oriented electrical steel sheet.

Regarding the production of a high magnetic flux density steel sheet, steel materials containing a small amount of acid soluble Al (herein called simply Al) are used, which are disclosed in Japanese Patent Publications Sho 33-4710, Sho 40-15644 and Sho 46-23820, which correspond to U.S. Pats. Nos. 3,159,511; 3,287,183 and 3,636,579, respectively. The feature of this prior art is that a strong reduction between 81 and 95% is applied in the final cold rolling step utilizing the effects of AlN.

Generally, in the production of grain-oriented electrical steel sheets, excellent magnetic characteristics in the rolling direction can be obtained due to the secondary recrystallization of Goss structure showing an orientation {110} <100> in the final annealing, and in this case precipitates, such as, nitrides, sulfides and oxides formed by addition elements pay an important role. Conventionally, the contribution of these precipitates has been considered to restrict the grain growth of the matrix by their finely dispersed precipitation into the matrix and to promote the secondary recrystallization.

However, in the case of AlN, as disclosed in U.S. Pat. No. 3,626,309, for example, AlN precipitates in a specific orientation in relation to the matrix and has the ability to make the grains of a specific orientation grow selectively, and strictly controls the orientation of the secondary recrystallization grains so that products having excellent $B_8$ characteristics can be obtained.

The present inventors have found that the diameter of the rolls used in the above strong reduction cold rolling have a great influence on the magnetic properties of the final products in the production of high magnetic flux density electrical steel sheets utilizing the effects of AlN.

It is already well known that a small-diameter roll can be used for rolling common steels. As an example of this small-diameter roll may be cited the Senzimir mill described in the Encyclopedia of the Iron and Steel Industry by A. K. Osborne (New York, 1956). An attempt to manufacture thin (0.5 – 7 mils) silicon steel sheets by using a Senzimir mill, is disclosed by M. F. Littmann in the U.S. Pat. No. 2,473,156 specification. The highest magnetic flux density obtained in the silicon steel sheet proposed by M. F. Littmann is $\mu_{H=10}$ = 1815 (example D) at the highest. Moreover, the starting material and cold rolling reduction ratio must be strictly controlled in order to obtain such magnetic flux density. However, it can not be said that the grain-oriented electrical steel sheet possesses high characteristic value in case $\mu_{H=10}$ is about 1815. No comment was made on the inhibitor effective for the growth of {100} <100> structure at the time of secondary recrystallization.

SUMMARY OF THE INVENTION

The present invention provides a process for steadily imparting the high characteristic of magnetic flux density, $B_8$, exceeding 1.90 Wb/m$^2$ to the final product, by using AlN-containing silicon steel sheet and applying a working roll having a diameter not larger than 300 mm in the cold rolling process of the manufacturing procedure of the silicon steel sheet.

Namely, the ordinary cold rolling conditions for stable production of high magnetic flux density steel sheets having low iron loss value require several passes of rollings in one step of cold rolling for rolling hot rolled plates into the final predetermined thickness. In this case, it has been found by the present inventors that the roll diameter must be not more than 300 mm when the rolling is done with the same diameter rolls, and that when the rolls of different diameters are used, at least one pass of rolling must be done using rolls of diameter not more than 300 mm and a final pass of not less than 10% reduction must be included in the last half of the rolling step.

Although the reasons of the above effects have not been fully clarified, it is most probable that a slight change occurs in the slip system in the surfacial portion of the sheet during the cold rolling by the difference of the roll diameter due to the presence of very sensitive secondary recrystallization nuclei of {100} <001> orientation, and this change gives rise to a change in the grain orientation of the primary recrystallization grains and causes differences in the growth of the specific secondary recrystallization grains caused by AlN.

The propagation of the stress exerted by the roll on the steel sheet in the direction of the thickness during the rolling varies depending on the largeness of the roll diameter. In case the roll diameter is large, the vertical component increases in proportion and the deformation is that of compressive working, making the stress propagation relatively uniform in the direction of sheet thickness. As a consequence, the growth of nuclei other than the nuclei of the Goss orientation in the middle portion of the sheet thickness becomes possible in the subsequent annealing treatment, and the product possessing inferior directional property is obtained as the result.

In case the roll diameter is small, the horizontal component becomes large in proportion and the stress distribution in the direction of sheet thickness is nonuniform, the stress difference being large in the middle portion. As a consequence, the nuclei of the Goss orientation present in the surface portion undergo accelerated growth, and the product possessing the superior directional property is thus obtained.

The other objects of the present invention will be evident from the description in the present specification and the drawings annexed thereto.

The present invention will be described in more details referring to the attached drawings.

DESCRIPTION OF THE PREFERRED EMBODIMENT

Figure 1:
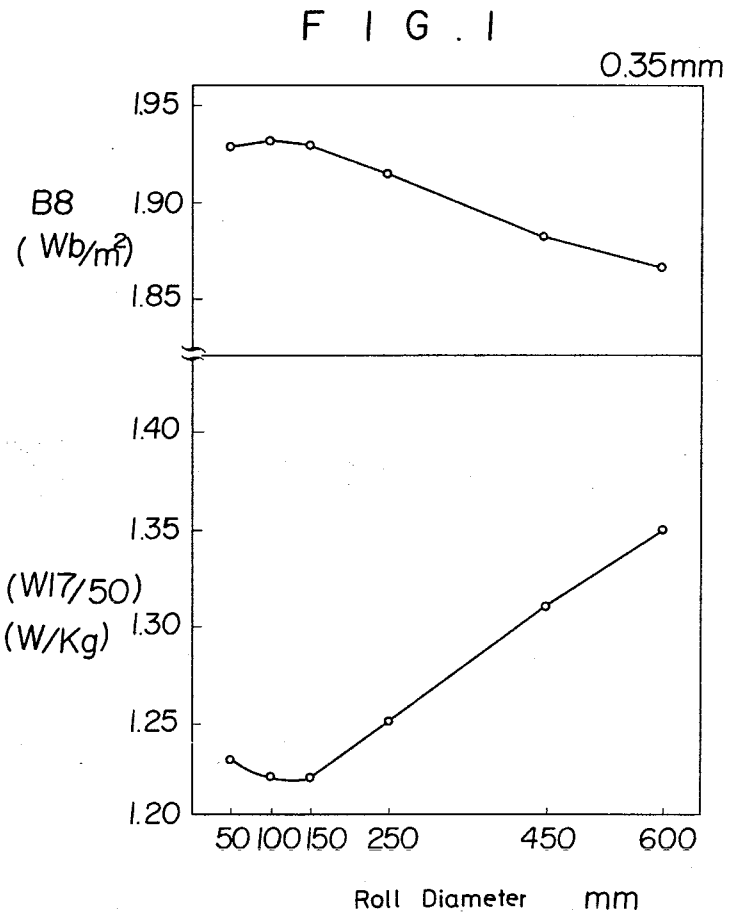
FIG. 1 is a graph showing the magnetic properties of the product produced according to Example 1.

The steel material composition to which the present invention is applied should satisfy the following requirements as a high magnetic flux density grain-oriented steel sheet.

The steel material must contain, by weight, 2.5 to 4.0% Si, not more than 0.085% C, and 0.010 to 0.065% acid soluble Al.

Si contents of more than 4% are not desirable because they cause difficulties in the cold rolling. On the other hand, at Si contents less than 2.5%, disadvantages, such as, lowered electric resistance and increased iron loss value are caused.

Carbon must be present in an amount sufficient to produce a $\gamma$ transformation at least a part of the steel depending on the Si content. Carbon contents more than 0.085% are not desirable because high magnetic flux density products can not be obtained and it is difficult to attain full decarburization annealing.

Al is the principal element for obtaining the high magnetic flux density products of the present invention, and when the aluminum content is outside the above range, the secondary recrystallization grains are unstable and high magnetic flux density products can not be obtained.

In addition to the above basic elements, other elements, such as, S may be contained within the scope of the present invention. Nitrogen is usually contained in an amount more than 0.002% in commercial steels and this level of nitrogen content is enough for producing the AlN important to the present invention.

In the present invention, steel ingots or slabs produced by known steel making methods can be used as starting materials.

The starting materials are hot rolled into 1.75 – 4.6 mm thick hot rolled coils. In the present invention, the cold rolling is effected in one step or in two steps including an intermediate annealing, but the final cold rolling process (the one-step cold rolling process is, in itself, the final cold rolling process; the second cold rolling process is the final in the two-step cold rolling) must be carried out at a high reduction ratio of 81 – 95% in order to obtain a high magnetic flux density grain-oriented electrical steel sheet. It is desirable that the thickness of cold rolled steel sheet after the final cold rolling is in a range of 9 – 14 mils (about 0.23 – 0.35 mm).

Prior to this final cold rolling with a strong reduction, annealing for precipitation of Al is effected in a temperature range of 950° to 1200° C for 30 seconds to 30 minutes. Depending on the C and Si contents, the steel is cooled rapidly from the temperature range of 750° to 950° C down to 400° C within 2 to 200 seconds to precipitate Al. When the annealing temperature and time and the cooling condition are outside the above ranges, the secondary recrystallization grains become unstable and thus high magnetic flux density products can not be obtained.

The feature of the present invention lies in the final cold rolling process of the AlN-containing steel sheet in a high reduction ratio.

This strong reduction cold rolling may be done by any of the known rolling mill stands, but in the case when the final thickness or substantially final thickness of the sheet is to be obtained by using rolls of the same diameter, the diameter must not exceed 300 mm. If the roll diameter exceeds 300 mm, products of excellent magnetic properties can not be obtained. The lower limit of the roll diameter may be very small so long as the rolling work is possible, and is preferably 50 mm.

Further, in the case when the steel sheet is rolled to the final sheet thickness by employing rolls of diameter over 300 mm and under 300 mm, it is best to work by using the roll of diameter under 300 mm in the latter half of the rolling process in a reduction ratio not lower than 10%. That is, the steel sheet must be rolled by a small-diameter roll of diameter under 300 mm through at least one pass including the substantial final pass. In this case, if the roll diameter is more than 300 mm, the desired improvements of the properties can not be obtained. It is also necessary that the substantially final rolling pass is done with a reduction rate of not less than 10% and if the reduction rate is less than 10%, no improvement of the magnetic properties can be obtained. These conditions will be clarified by the description of examples shown hereinafter.

The substantial final pass mentioned in the description of the present invention refers naturally to the final pass in the final heavy cold rolling by which the steel sheet is rolled substantially to the final sheet thickness, but also, in some occasions, includes a process of reaching the final dimension by rolling in a low reduction ratio of several %, such as, skin pass rolling effected in a process after the final heavy cold rolling process.

In the present invention, it is desirable that the roll diameter is not less than 50 mm, because the difference in working stress becomes more marked in the direction of sheet thickness when the roll diameter is 50 mm or smaller. As a consequence, the strain undergone by the nuclei of advantageous orientation in the surface portion becomes too great, and the subsequent recovery of strain and growth proceed more slowly than those of the nuclei of the other orientations in the middle portion. This causes inferiority in the directional property of the product.

The present invention will be clearly understood from the following examples.

EXAMPLE 1

The steel material containing 0.04% C, 2.9% Si, 0.03% Al was hot rolled into 2.3 mm thickness.

This hot rolled steel sheet was annealed at 1150° C, for 2 minutes, acid pickled and rolled into the final thickness of 0.35 mm with a total reduction ratio of 85% by a single strong cold rolling through six passes using six roll diameters as shown in the Table 1.

Table 1

| | Roll Diameter | Number of pass | Reduction Rate in final pass |
|---|---|---|---|
| Present Invention | 50 mm | 6 | 7 % |
| " | 100 | " | 17 |
| " | 150 | " | 6 |
| " | 250 | " | 15 |
| Comparative | 450 | " | 17 |
| " | 600 | " | 6 |

The sheets thus obtained were subjected to decarburization annealing for 3 minutes at 850° C and final annealing for 20 hours at 1200° C to obtain final products.

Magnetic properties of the products obtained above are shown in FIG. 1.

An excellent $B_8$ characteristic of over 1.90 Wb/m² is obtained when the roll diameter is not more than 300 mm, and if the rolling is done by using a single roll diameter as in this case, the reduction rate in the final pass is not limited.

EXAMPLE 2

The same material as in Example 1 was hot rolled continuously annealed and acid pickled and then cold rolled into the final thickness of 0.35 mm with a total reduction ratio of 85% by single strong cold rolling under 5 kinds of conditions shown in Table 2.

Table 2

| Pass No. | 1 | | 2 | | 3 | | 4 | |
|---|---|---|---|---|---|---|---|---|
| Conditions | Roll Diameter | Reduction Rate | Roll Diameter | Reduction Rate | Roll Diameter | Reduction Rate | Roll Diameter | Reduction Rate |
| A | 50 mm | / % | 50 mm | / % | 50 mm | / % | 50 mm | / % |
| B | 450 | / | 450 | / | 450 | / | 450 | / |
| C | 600 | / | 600 | / | 600 | / | 600 | / |
| D | 600 | / | 600 | / | 600 | / | 600 | / |
| E | 450 | / | 450 | / | 450 | / | 450 | / |

| Pass No. | 5 | | 6 | | 7 | | 8 | |
|---|---|---|---|---|---|---|---|---|
| Conditions | Roll Diameter | Reduction Rate | Roll Diameter | Reduction Rate | Roll Diameter | Reduction Rate | Roll Diameter | Reduction Rate |
| A | 50 mm | / % | 50 mm | / % | — mm | — % | — mm | — % |
| B | 450 | / | 450 | / | 450 | / | 50 | 12 |
| C | 600 | / | 600 | / | 50 | / | 50 | 25 |
| D | 600 | / | 600 | / | 50 | 16 | — | — |
| E | 450 | / | 450 | 17 | — | — | — | — |

* / means that the reduction rate is not specifically limited.

The thus obtained sheets were subjected to decarburization annealing and final annealing under the same conditions as in Example 1.

Figure 2:
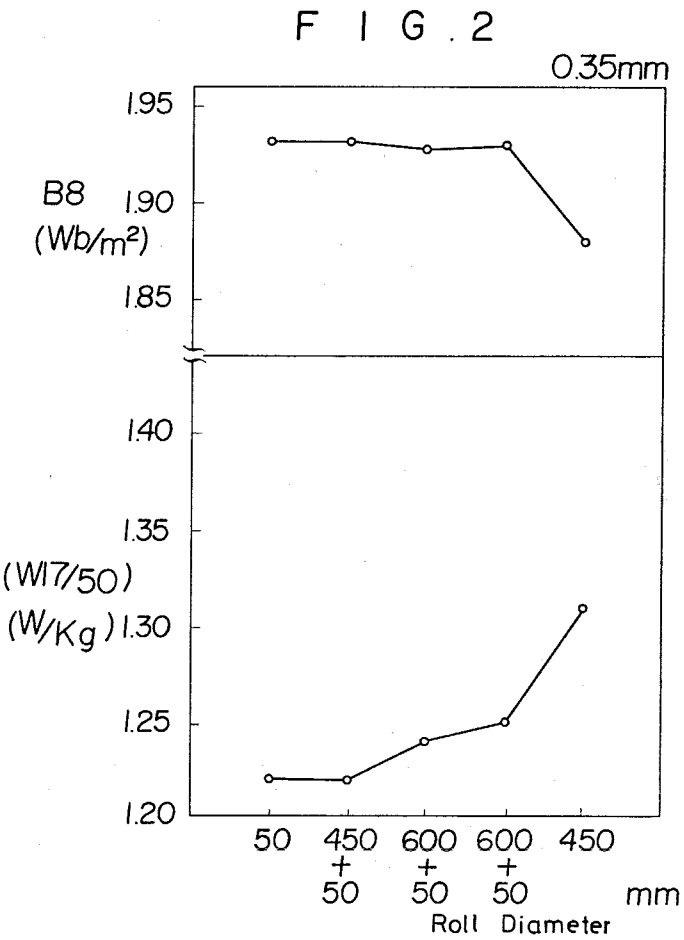
FIG. 2 is a graph showing the magnetic properties of the product produced according to Example 2.

Magnetic properties of the products are shown in FIG. 2. In the case when rolls of different diameters are used to obtain products possessing a $B_8$ characteristic over 1.90 Wb/m², it is necessary that a final pass of not less than 10% reduction is included in the last half stage of the cold rolling and that at least one pass is done using a smaller roll diameter.

EXAMPLE 3

The steel material containing 0.04%C, 2.8% Si, 0.02% Al was hot rolled into 2.3 mm thickness.

The steps after the hot rolling were the same as in Example 1 except for the cold rolling.

The cold rolling conditions were as shown in Table 3 and the sheets were finished into a 0.3 mm thickness with a total reduction ratio of 87%.

Table 3

| Pass No. | 1 | | 2 | | 3 | | 4 | |
|---|---|---|---|---|---|---|---|---|
| Conditions | Roll Diameter | Reduction Rate | Roll Diameter | Reduction Rate | Roll Diameter | Reduction Rate | Roll Diameter | Reduction Rate |
| A | 50mm | /% | 50mm | /% | 50mm | /% | 50mm | /% |
| B | 600 | / | 600 | / | 600 | / | 600 | / |
| C | 600 | / | 600 | / | 600 | / | 600 | / |
| D | 600 | / | 600 | / | 600 | / | 600 | / |
| E | 600 | / | 600 | / | 600 | / | 600 | / |

Table 3-continued

| F | 600 | / | 600 | / | 600 | / | 600 | / |
|---|---|---|---|---|---|---|---|---|
| Pass No. | 5 | | 6 | | 7 | | 8 | |
| Conditions | Roll Diameter | Reduction Rate | Roll Diameter | Reduction Rate | Roll Diameter | Reduction Rate | Roll Diameter | Reduction Rate |
| A | 50mm | /% | 50mm | 14% | —mm | —% | —mm | —% |
| B | 600 | / | 600 | / | 50 | / | 50 | 13 |
| C | 600 | / | 600 | / | 150 | / | 150 | 16 |
| D | 600 | / | 600 | / | 250 | / | 250 | 16 |
| E | 600 | / | 600 | / | 450 | / | 450 | 13 |
| F | 600 | / | 600 | 13 | — | — | — | — |

* / means that the reduction rate is not specifically limited.

Figure 3:
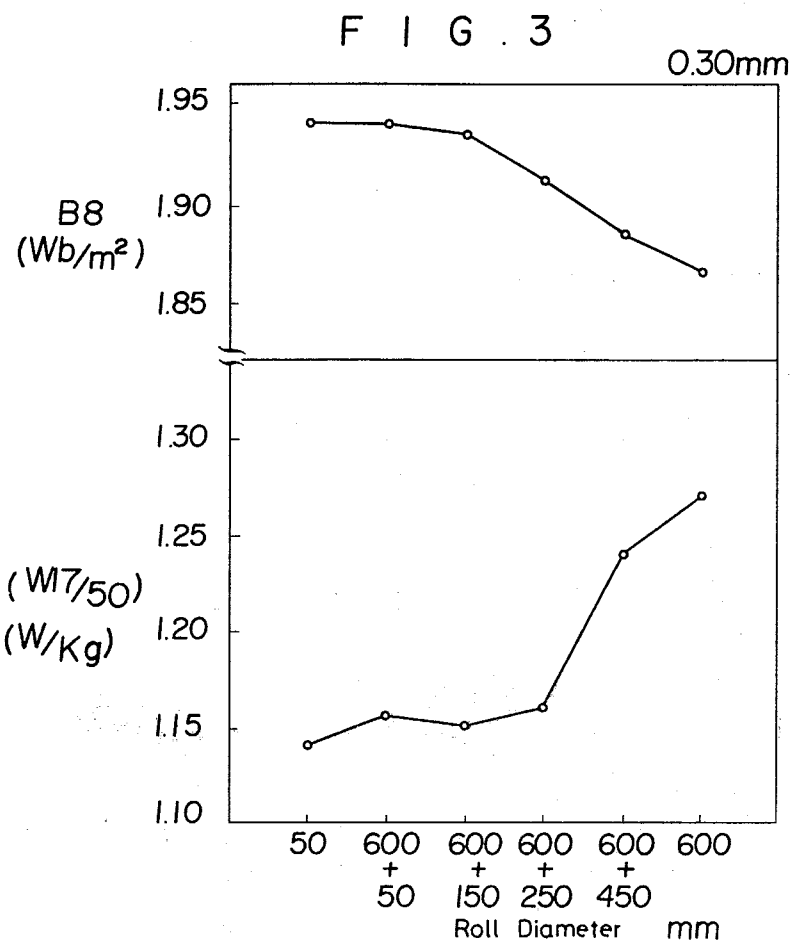
FIG. 3 is a graph showing the magnetic properties of the product produced according to Example 3.

Magnetic properties of the products are shown in FIG. 3. A product having excellent $B_8$ characteristic over 1.9 Wb/m² is obtained when the roll diameter is not more than 300 mm.

EXAMPLE 4

The same steel material as in Example 3 was processed in the same manner as in Example 1 except for the cold rolling.

The cold rolling conditions were as shown in Table 4, and the sheets were finished into 0.30 mm thickness with a total reduction ratio of 87%.

Table 4

| Pass No. | 1 | | 2 | | 3 | | 4 | |
|---|---|---|---|---|---|---|---|---|
| Conditions | Roll Diameter | Reduction Rate | Roll Diameter | Reduction Rate | Roll Diameter | Reduction Rate | Roll Diameter | Reduction Rate |
| A | 50mm | /% | 50mm | /% | 50mm | /% | 50mm | /% |
| B | 450 | / | 450 | / | 450 | / | 450 | / |
| C | 50 | / | 50 | / | 50 | / | 50 | / |
| D | 450 | / | 450 | / | 450 | / | 450 | / |

| Pass No. | 5 | | 6 | |
|---|---|---|---|---|
| Conditions | Roll Diameter | Reduction Rate | Roll Diameter | Reduction Rate |
| A | 50mm | /% | 50mm | 14% |
| B | 50 | / | 50 | 16 |
| C | 450 | / | 450 | 17 |
| D | 450 | / | 450 | 15 |

* / means that the reduction rate is not specifically limited.

Figure 4:
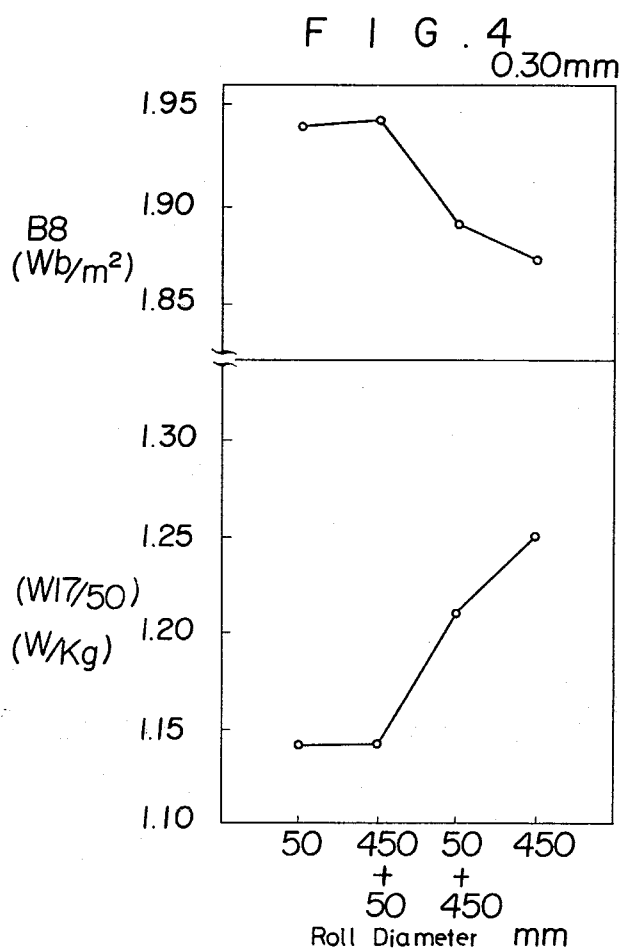
FIG. 4 is a graph showing the magnetic properties of the product produced according to Example 4.

Magnetic properties of the products are shown in FIG. 4.

To obtain a product having $B_8$ characteristic over 1.9 Wb/m², it is important that the roll diameter especially of the latter half stage is small.

From the foregoing, it is clear that the roll diameter is important.

What is claimed is:

1. In a method for producing high magnetic flux density grain-oriented electrical steel sheet or strip wherein a a. steel material consisting essentially of 2.5% to 4.0% Si, not more than 0.085%C and 0.010 to 0.065% acid soluble Al is hot rolled to obtain a hot-rolled, 1.75 - 4.6 mm thick plate, the hot rolled plate is continuously annealed at a temperature between 950 and 1200° C;

b. the plate is rapidly cooled to precipitate AlN;

c. the cooled plate cold-rolled into a final thickness of 0.23 - 0.35 mm by a one-step cold rolling or a two-step cold rolling including a final strong reduction rolling between 81 and 95%, and the cold rolled plate is continuously annealed for decarburization, and is finishing box annealed, the improvement which comprises using a roll having a diameter not larger than 300 mm in the final cold rolling stage with a strong reduction such that excellent magnetic properties with a $B_8$ characteristic not less than 1.9 Wb/m² are obtained.

2. The method of claim 1, wherein a roll not larger than 300 mm in diameter is used for all the rolling stages of the final cold rolling process.

3. The method of claim 1, wherein the final cold rolling process is carried out using a roll not smaller than 300 mm in diameter with a roll not larger than 300 mm in diameter with at least one pass of rolling including a final pass with a reduction ratio of greater than 10% in the latter half of the rolling process.

4. The method of claim 1, wherein the diameter of the small-diameter roll is from 50 to 300 mm.

* * * * *